US008474389B2

(12) United States Patent
Otsuka et al.

(10) Patent No.: US 8,474,389 B2
(45) Date of Patent: Jul. 2, 2013

(54) PERSONAL WATERCRAFT

(75) Inventors: Kenichi Otsuka, Shizuoka (JP); Yoshiyuki Kaneko, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 215 days.

(21) Appl. No.: 13/070,641

(22) Filed: Mar. 24, 2011

(65) Prior Publication Data

US 2012/0180715 A1 Jul. 19, 2012

(30) Foreign Application Priority Data

Jan. 13, 2011 (JP) ..... 2011-005025

(51) Int. Cl.
*B63B 17/00* (2006.01)

(52) U.S. Cl.
USPC ..... 114/55.57; 114/363

(58) Field of Classification Search
USPC ..... 114/55.57, 363
See application file for complete search history.

(56) References Cited

U.S. PATENT DOCUMENTS

| | | | | |
|---|---|---|---|---|
| 5,572,943 | A * | 11/1996 | Kobayashi et al. | 114/55.57 |
| 5,915,329 | A * | 6/1999 | Watkins et al. | 114/363 |
| 5,964,172 | A | 10/1999 | Ikeda | |
| 6,041,732 | A * | 3/2000 | Ikeda | 114/363 |
| 7,017,507 | B2 | 3/2006 | Hattori et al. | |
| 8,261,683 | B2 * | 9/2012 | Knoblett et al. | 114/363 |

FOREIGN PATENT DOCUMENTS

| | | | |
|---|---|---|---|
| JP | 10-035581 | A | 2/1998 |
| JP | 2005-306314 | A | 11/2005 |

* cited by examiner

*Primary Examiner* — Lars A Olson
(74) *Attorney, Agent, or Firm* — Keating & Bennett, LLP

(57) ABSTRACT

A sectional shape of a seat provided on a personal watercraft includes first to third seat portions, first to third hip support portions, and first and second rearward inclined portions. The first hip support portion extends rearward to a height higher than the second seat portion from the first seat portion. The second hip support portion extends rearward to a height higher than the third seat portion and higher than the first hip support portion from the second seat portion. The third hip support portion extends rearward to a height higher than the second hip support portion from the third seat portion. The second rearward inclined portion is inclined at an inclination angle larger than an inclination angle of the first rearward inclined portion with respect to a horizontal plane.

3 Claims, 7 Drawing Sheets

PERSONAL WATERCRAFT

BACKGROUND OF THE INVENTION

1. Field of the Invention

The present invention relates to a personal watercraft.

2. Description of the Related Art

A personal watercraft including a three-seater seat is known. The conventional personal watercraft described in U.S. Pat. No. 5,964,172 includes a three-seater seat extending in the front-rear direction. This seat includes three seat portions disposed at intervals in the front-rear direction, a protrusion (hump) provided between the foremost seat portion and the middle seat portion, and a hip support portion (upstanding surface) provided between the middle seat portion and the rearmost seat portion. The hips of a rider sitting on the forefront seat portion are supported by the protrusion, and the hips of a rider sitting on the middle seat portion are supported by the hip support portion.

On the other hand, the conventional personal watercraft described in U.S. Pat. No. 7,017,507 includes a three-seater seat extending in the front-rear direction. This seat includes two seat portions disposed at an interval in the front-rear direction, a first hip support portion (first raised portion) provided between the two seat portions, and a second hip support portion (second raised portion) provided at the rear of the rearmost seat portion. The seat is arranged so that the rearmost seat portion is substantially flat and two riders can sit aligned front and rear. The hips of a rider sitting on the forefront seat portion are supported by the first hip support portion, and the hips of a rider sitting on the rear portion of the rearmost seat portion are supported by the second hip support portion.

SUMMARY OF THE INVENTION

The inventors of preferred embodiments of the present invention described and claimed in the present application conducted an extensive study and research regarding a personal watercraft, such as the ones described above, and in doing so, discovered and first recognized new unique challenges and previously unrecognized possibilities for improvements as described in greater detail below.

In detail, in a personal watercraft including a three-seater seat, it is desired that three riders can sit comfortably. Therefore, it is possible that three hip support portions having sufficient heights are provided on the seat to support the hips of each rider.

In detail, it is conceivable that three seat portions are disposed at different heights so that the middle seat portion is positioned at a height between the forefront seat portion and the rearmost seat portion and sufficient height differences occur among the three seat portions, and a hip support portion having a sufficient height is provided at the rear of the rearmost seat portion. In this case, at the rear of the forefront seat portion, a hip support portion having a sufficient height is formed by a height difference between the forefront seat portion and the middle seat portion. Similarly, at the rear of the middle seat portion, a hip support portion having a sufficient height is formed by a height difference between the middle seat portion and the rearmost seat portion. Accordingly, the hip support portions having sufficient heights are provided at the rear of the seat portions. Therefore, when a rider sits on any of the seat portions, the hips of the rider are supported by the hip support portion. Accordingly, the comfort of the riders can be improved.

However, if the three seat portions are disposed at different heights so that sufficient height differences occur among the three seat portions, the total height of the seat increases. Therefore, it is preferable to improve the comfort of the riders while minimizing an increase in the total height of the seat.

On the other hand, in U.S. Pat. No. 5,964,172, a protrusion is provided between the forefront seat portion and the middle seat portion, and the hip support portion is provided between the middle seat portion and the rearmost seat portion. However, the protrusion and the hip support portion do not have sufficient heights, so that the protrusion and the hip support portion cannot support the hips of the riders sitting on the seat in some cases. Therefore, although an increase in the total height of the seat can be minimized, it is difficult to secure sufficient comfort of the riders. Specifically, it is difficult to realize both of minimization of an increase in the total height of the seat and improvement in the comfort of the riders.

In U.S. Pat. No. 7,017,507, the seat is arranged so that the rearmost seat portion is substantially flat and two riders can sit front and rear in a line. The hips of a rider sitting on the rear portion of the rearmost seat portion are supported by the second hip support portion. However, the hips of a rider sitting on the front portion of the rearmost seat portion are not supported by the second hip support portion. Therefore, although an increase in the total height of the seat can be minimized, it is difficult to sufficiently secure the comfort of the riders.

In order to overcome the previously unrecognized and unsolved challenges described above, a preferred embodiment of the present invention provides a personal watercraft including a seat. The seat has a sectional shape that appears when the seat is cut along a vertical surface along a center in a width direction of the personal watercraft. The sectional shape of the seat preferably includes a first seat portion, a second seat portion, a third seat portion, a first hip support portion, a second hip support portion, a third hip support portion, a first rearward inclined portion, and a second rearward inclined portion.

The first seat portion is disposed along a horizontal plane. The second seat portion is disposed along a horizontal plane rearward relative to the first seat portion and higher than the first seat portion. The third seat portion is disposed along a horizontal plane rearward relative to the second seat portion and higher than the second seat portion. A height difference between the second seat portion and the third seat portion is smaller than a height difference between the first seat portion and the second seat portion.

The first hip support portion is disposed forward relative to the second seat portion. The first hip support portion is arranged to extend rearward from a rear end of the first seat portion to a height higher than the second seat portion. The second hip support portion is disposed forward relative to the third seat portion. The second hip support portion is arranged to extend rearward from a rear end of the second seat portion to a height higher than the third seat portion and higher than an upper end of the first hip support portion. The third hip support portion is arranged to extend rearward from a rear end of the third seat portion to a height higher than an upper end of the second hip support portion.

The first rearward inclined portion is arranged to connect the upper end of the first hip support portion and a front end of the second seat portion. The first rearward inclined portion is inclined such that an upper end of the first rearward inclined portion is positioned forward relative to a lower end of the first rearward inclined portion. The second rearward inclined portion is arranged to connect the upper end of the second hip support portion and a front end of the third seat portion. The second rearward inclined portion is inclined at an inclination angle larger than an inclination angle of the first rearward inclined portion with respect to a horizontal plane such that an upper end of the second rearward inclined portion is positioned forward relative to a lower end of the second rearward inclined portion.

With this arrangement of the present preferred embodiment of the present invention, the first hip support portion, the second hip support portion, and the third hip support portion corresponding to the first seat portion, the second seat portion, and the third seat portion, respectively, are provided on the seat. Each hip support portion extends obliquely upward to the rear side from the rear end of the corresponding seat portion. Accordingly, a sufficient height is secured for each hip support portion. Therefore, when a rider sits on any of the seat portions, the hips of the rider are supported by the hip support portion. Further, the first seat portion, the second seat portion, and the third seat portion are disposed along a horizontal plane at different heights so that the second seat portion is positioned at a height between the first seat portion and the third seat portion. The height difference between the second seat portion and the third seat portion is smaller than the height difference between the first seat portion and the second seat portion. Therefore, an increase in the total height of the seat is minimized. Further, the second rearward inclined portion is inclined at an inclination angle larger than an inclination angle of the first rearward inclined portion with respect to a horizontal plane. Therefore, an increase in the total height of the seat is minimized, and the height of the second hip support portion increases. Therefore, the hips of a rider sitting on the second seat portion are supported by the second hip support portion. Accordingly, while an increase in the total height of the seat is minimized, the comfort of the riders can be improved.

The first hip support portion may be inclined such that the upper end of the first hip support portion is positioned rearward relative to a lower end of the first hip support portion. The second hip support portion may be inclined at an inclination angle smaller than an inclination angle of the first hip support portion with respect to a horizontal plane such that the upper end of the second hip support portion is positioned rearward relative to a lower end of the second hip support portion.

A height difference between the upper end of the second hip support portion and the lower end of the second hip support portion may be equal to or substantially equal to a height difference between an upper end of the third hip support portion and a lower end of the third hip support portion.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, a personal watercraft in a reference posture will be described. The reference posture is a posture in which the personal watercraft floats in static water (water that stands still and does not move). The drawings show a personal watercraft in the reference posture.

Figure 1:
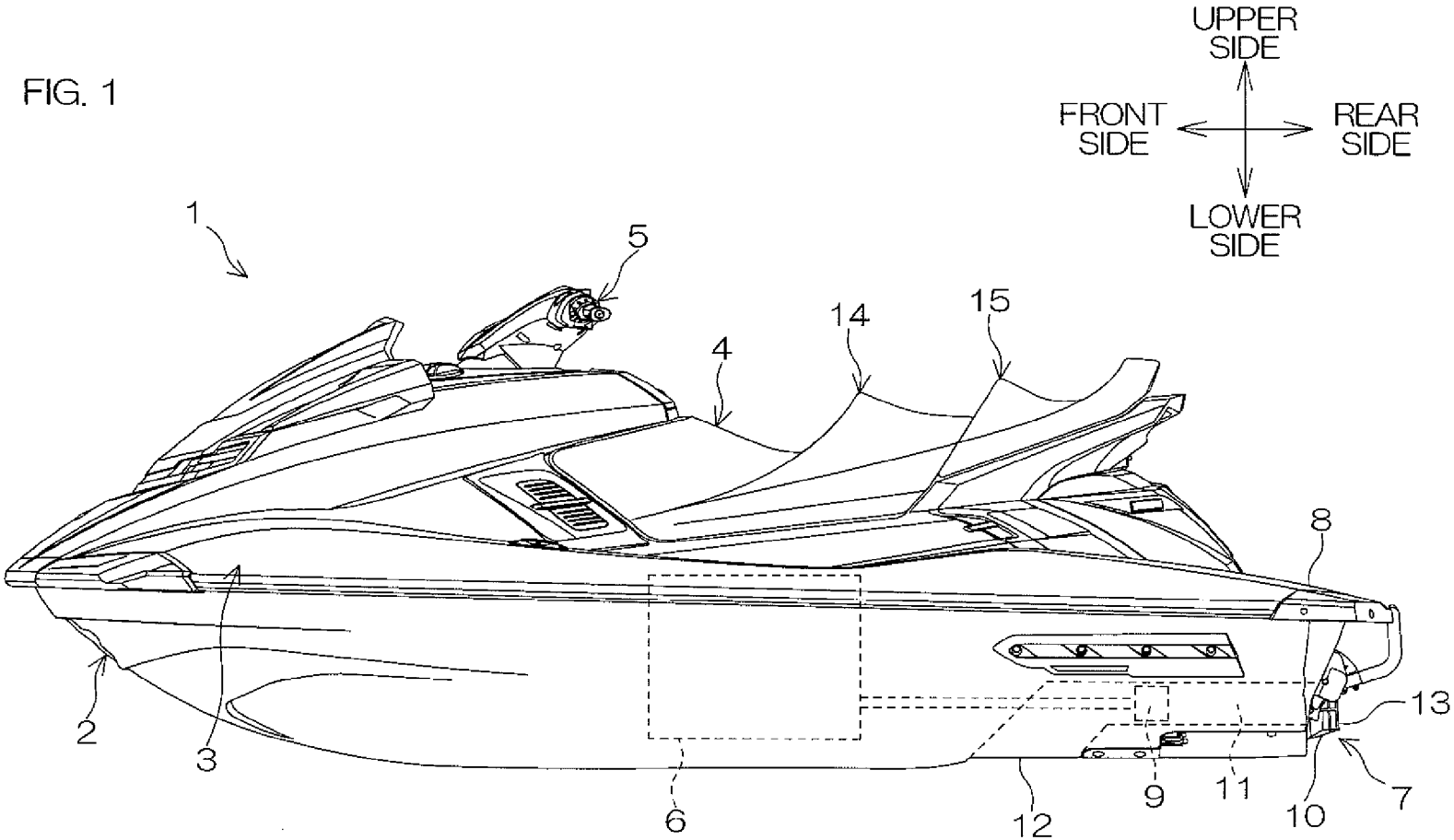
FIG. 1 is a side view of a personal watercraft according to a first preferred embodiment of the present invention.
Figure 2:
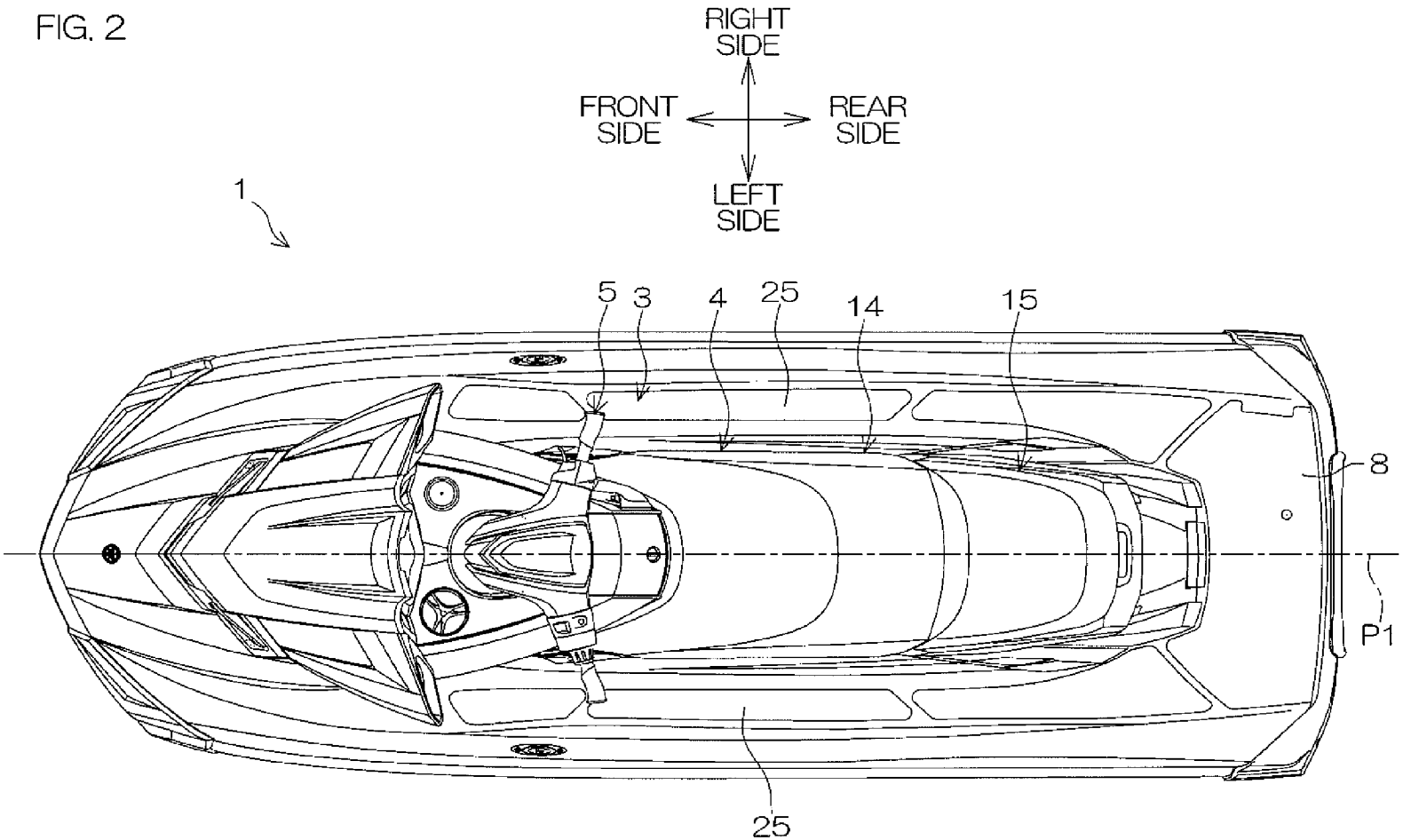
FIG. 2 is a plan view of the personal watercraft according to the first preferred embodiment of the present invention.

FIG. 1 is a side view of a personal watercraft 1 according to a first preferred embodiment of the present invention. FIG. 2 is a plan view of the personal watercraft 1 according to the first preferred embodiment of the present invention.

As shown in FIG. 1, the personal watercraft 1 includes a hull 2, a deck 3, a seat 4, and a steering handle 5. The deck 3 is disposed above the hull 2. The seat 4 and the steering handle 5 are disposed above the deck 3. The seat 4 and the steering handle 5 are supported on the deck 3. As shown in FIG. 2, the seat 4 and the steering handle 5 are disposed at the central portion of the personal watercraft 1 in the right-left direction (width direction). The seat 4 is disposed at the rear of the steering handle 5. The seat 4 extends in the front-rear direction in a plan view. The seat 4 is attached to the deck 3. The seat 4 is removable from the deck 3. The seat 4 may be directly attached to the deck 3, or may be attached to the deck 3 via a member. Specifically, for example, the seat 4 may be attached to the deck 3 via a hinge (not shown), and rotatable with respect to the deck 4.

As shown in FIG. 1, the personal watercraft 1 further includes an engine 6 and a jet pump 7. The engine 6 is disposed inside the hull 2. The jet pump 7 is disposed at the rear portion of the hull 2. The engine 6 is disposed forward relative to the jet pump 7. The seat 4 is disposed above the engine 6. The deck 3 includes a platform 8 disposed at the stern of the personal watercraft 1. The jet pump 7 is disposed below the platform 8. The jet pump 7 is driven by the engine 6.

The jet pump 7 is arranged to generate a propulsive force by jetting water suctioned from below rearward. In detail, as shown in FIG. 1, the jet pump 7 includes an impeller 9 joined to the engine 6 and a deflector 10 disposed at the rear of the impeller 9. The impeller 9 is disposed in a flow passage 11 provided inside the personal watercraft 1. A first end portion of the flow passage 11 defines an intake 12 opened at the bottom surface of the hull 2, and a second end portion of the flow passage 11 defines an outlet 13 opened at the deflector 10. The deflector 10 is arranged to turn to the right or left according to an operation of the steering handle 5.

When the impeller 9 is driven to rotate by the engine 6, water is suctioned from the intake 12 into the flow passage 11. Then, water suctioned into the flow passage 11 is jetted from the outlet 13. Accordingly, a propulsive force is generated to propel the personal watercraft 1. When the steering handle 5 is operated, the direction of the deflector 10 changes, and the jetting direction of water from the deflector 10 changes. Therefore, the steering handle 5 is arranged to change the jetting direction of water from the jet pump 7. The personal watercraft 1 is steered by operations of the steering handle 5.

Figure 3:
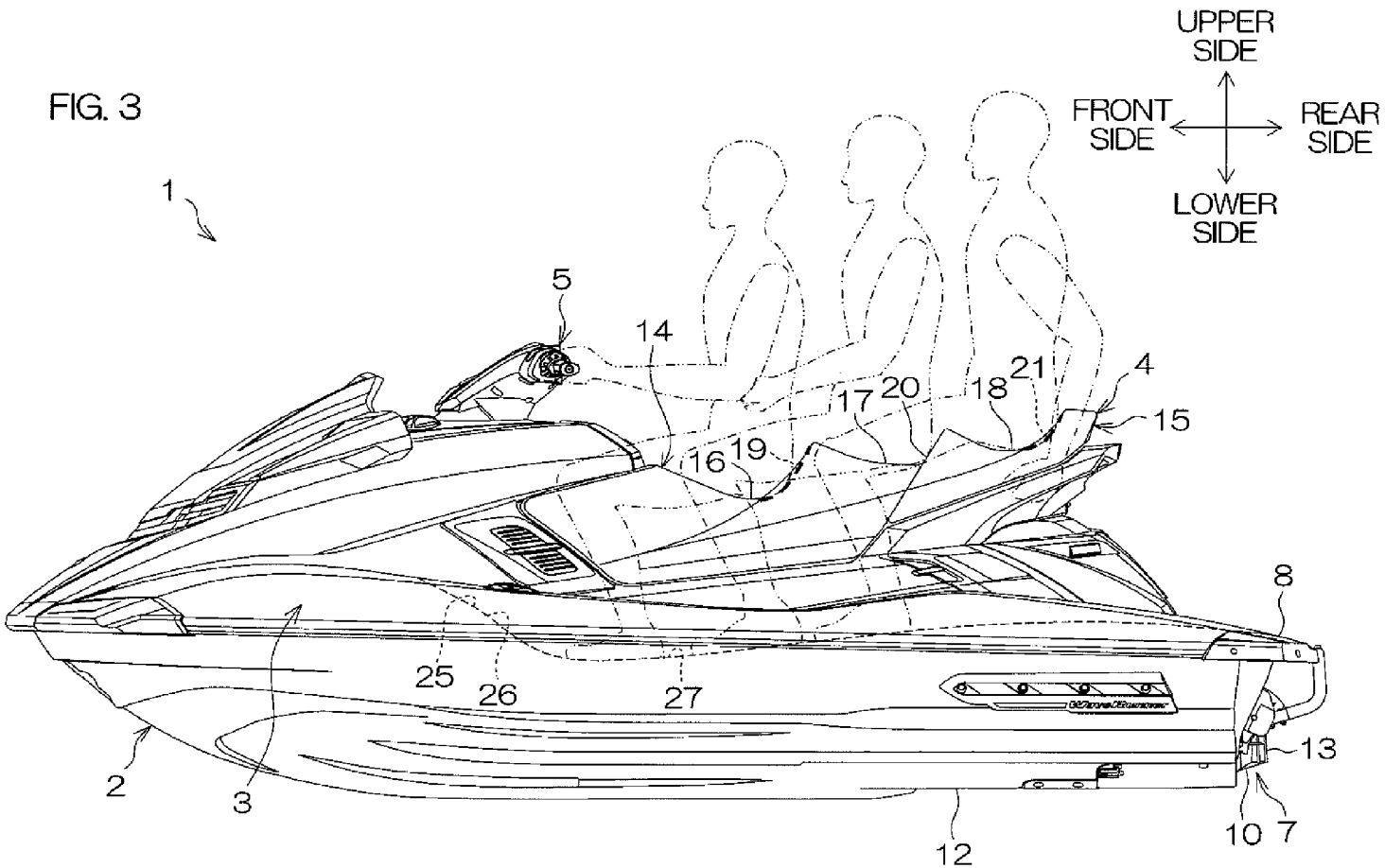
FIG. 3 is a side view showing a state in which three riders sit on the personal watercraft according to the first preferred embodiment of the present invention.
Figure 4:
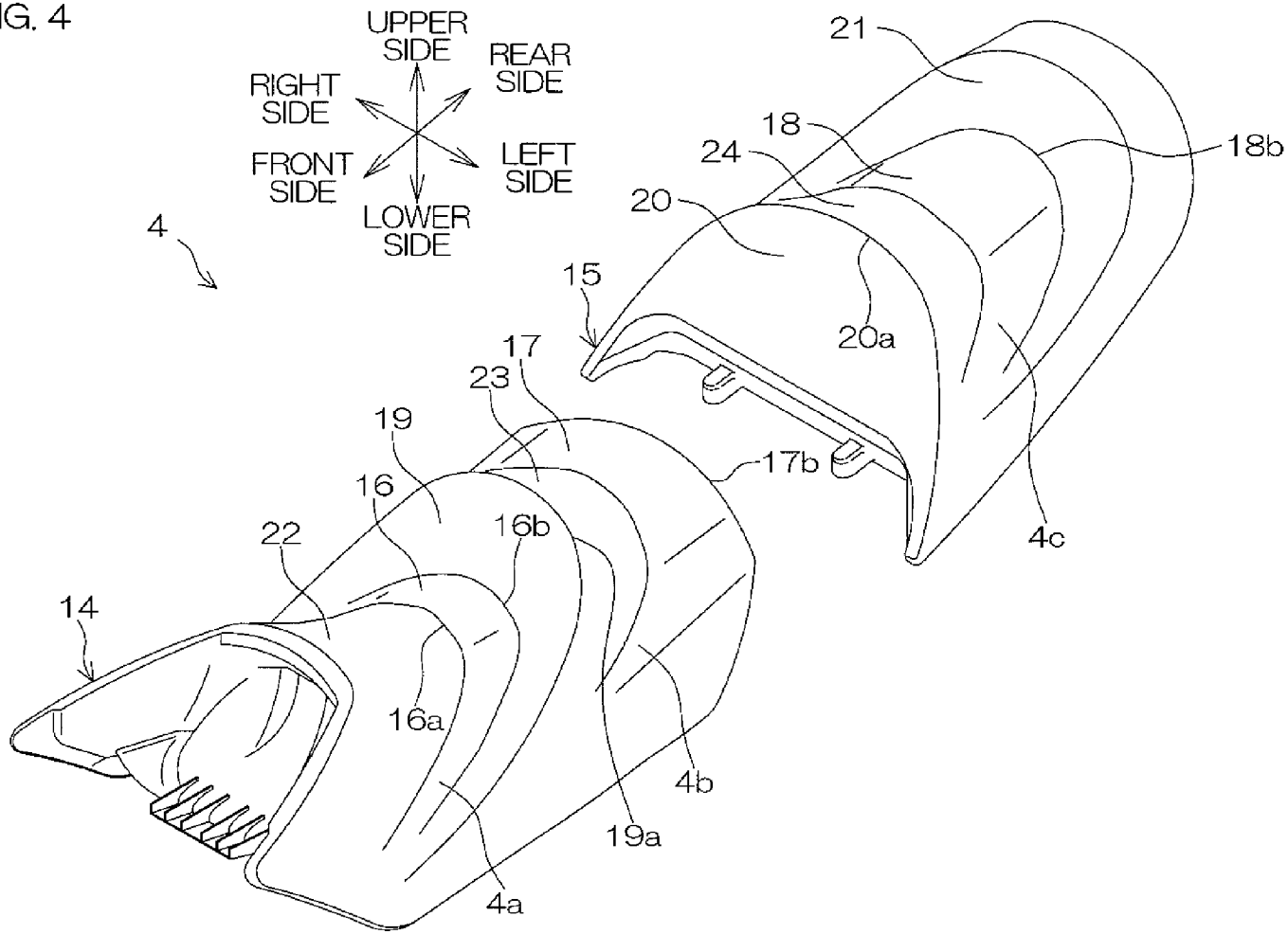
FIG. 4 is an exploded perspective view of a seat according to the first preferred embodiment of the present invention.

FIG. 3 is a side view showing a state in which three riders sit on the personal watercraft 1 according to the first preferred embodiment of the present invention. FIG. 4 is an exploded perspective view of the seat 4 according to the first preferred embodiment of the present invention. Hereinafter, FIG. 2 to FIG. 4 will be referred to as is appropriate.

As shown in FIG. 4, the seat 4 includes a front seat 14 and a rear seat 15 independent of each other. As shown in FIG. 3, the front seat 14 and the rear seat 15 are attached to the deck 3. The front seat 14 and the rear seat 15 are preferably removable from the deck 3 independently of each other. The front seat 14 is attached to the deck 3 on the side ahead of the rear seat 15. The front seat 14 and the rear seat 15 are attached to the deck 3 so that their outer surfaces are continuous with each other. Each of the front seat 14 and the rear seat 15 includes a cushion (not shown) and a seat cover covering the cushion. The front seat 14 and the rear seat 15 may be independent of each other, or may be integrated with each other.

As shown in FIG. 3, the seat 4 has a three-seater configuration. As shown in FIG. 4, the seat 4 includes three seating surfaces (a first seating surface 16, a second seating surface 17, and a third seating surface 18) disposed at intervals in the front-rear direction. Further, the seat 4 includes three hip support surfaces (a first hip support surface 19, a second hip support surface 20, and a third hip support surface 21) and three inclined surfaces (a first inclined surface 22, a second inclined surface 23, and a third inclined surface 24). The first inclined surface 22, the first seating surface 16, the first hip support surface 19, the second inclined surface 23, and the second seating surface 17 are preferably provided on the front seat 14. The second hip support surface 20, the third inclined surface 24, the third seating surface 18, and the third hip support surface 21 are preferably provided on the rear seat 15. The second hip support surface 20 is a portion of the front surface of the rear seat 15. As shown in FIG. 3, the hips of a rider (driver) sitting on the first seating surface 16 are supported by the first hip support surface 19. Similarly, the hips of a rider (fellow rider) sitting on the second seating surface 17 are supported by the second hip support surface 20, and the hips of a rider (fellow rider) sitting on the third seating surface 18 are supported by the third hip support surface 21.

As shown in FIG. 3, the deck 3 includes two foot floors 25 on which the feet of the riders can be placed. As shown in FIG. 2, the two foot floors 25 extend in the front-rear direction along the right end portion and the left end portion of the deck 3. The seat 4 is disposed between the two foot floors 25 in a plan view. As shown in FIG. 3, the two foot floors 25 are disposed lower than the seat 4. The foot floor 25 includes a forward inclined portion 26 inclined so that its front end is positioned higher than its rear end, and a rearward inclined portion 27 extending rearward from the rear end of the forward inclined portion 26 and inclined so that its front end is positioned lower than its rear end. The feet of a rider sitting on the first seating surface 16 are placed on the forward inclined portion 26 or the rearward inclined portion 27. The feet of the riders sitting on the second seating surface 17 and the third seating surface 18 are placed on the rear inclined portion 27.

Figure 5:
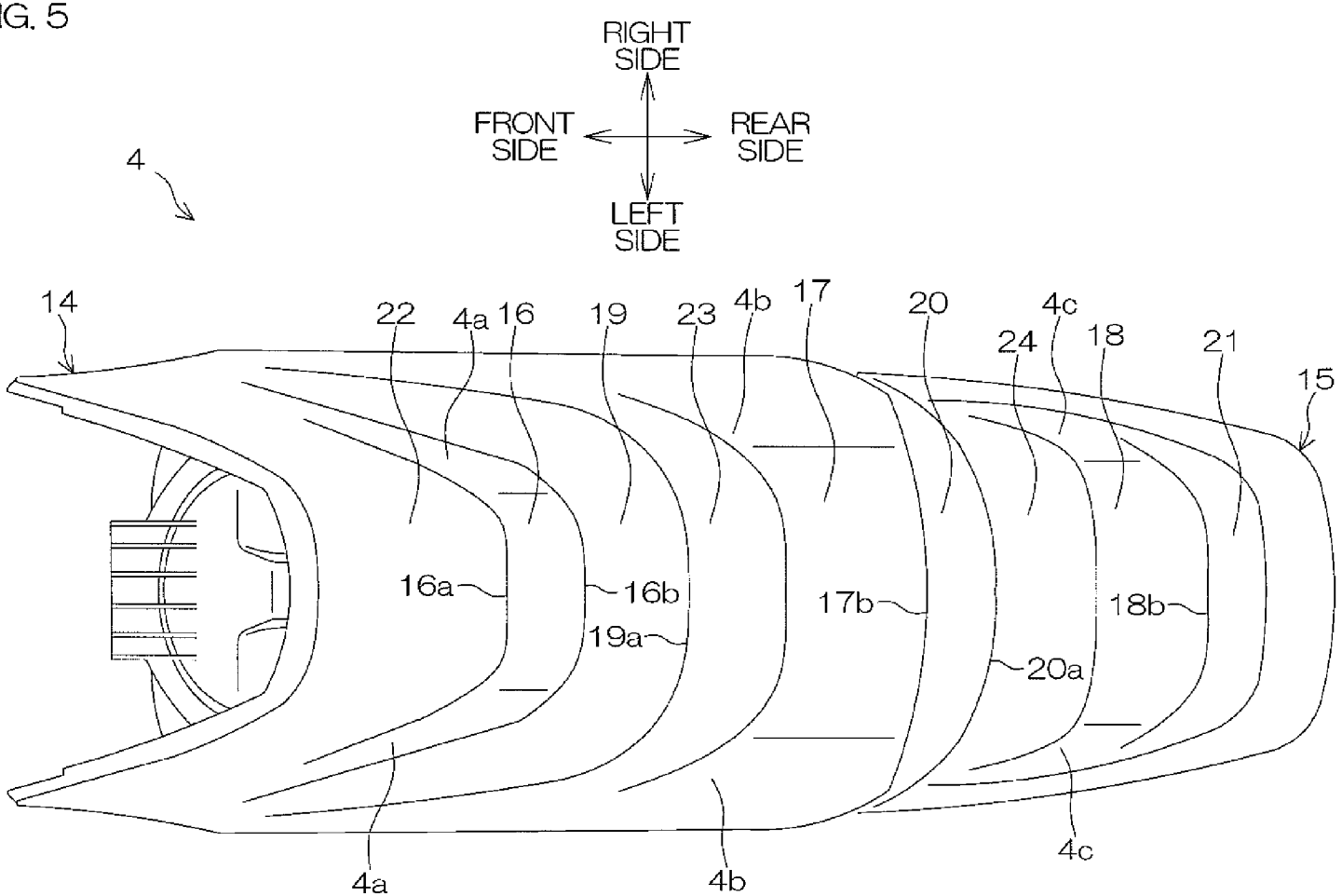
FIG. 5 is a plan view of the seat according to the first preferred embodiment of the present invention.
Figure 6:
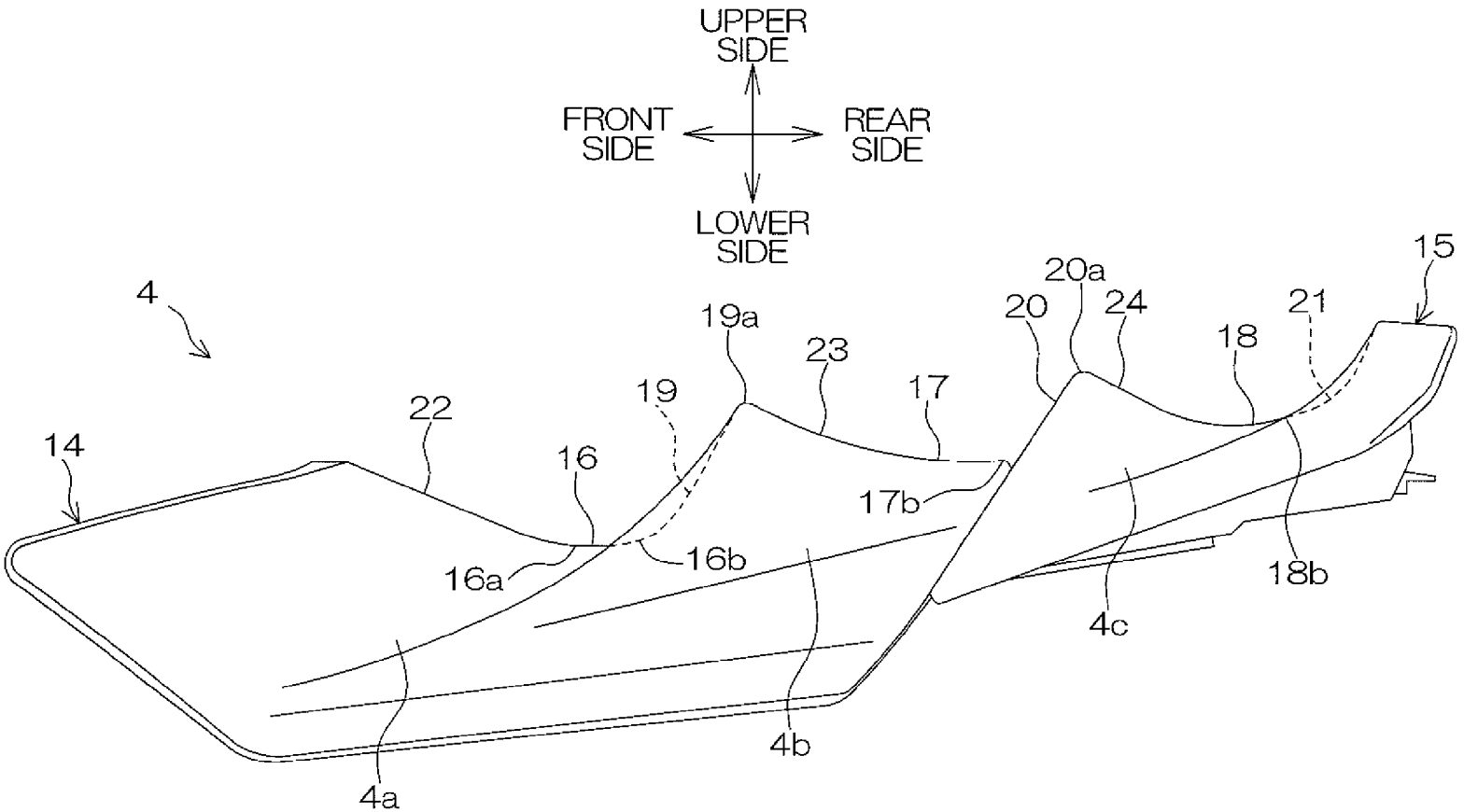
FIG. 6 is a side view of the seat according to the first preferred embodiment of the present invention.

FIG. 5 is a plan view of the seat 4 according to the first preferred embodiment of the present invention. FIG. 6 is a side view of the seat 4 according to the first preferred embodiment of the present invention. Hereinafter, FIG. 5 and FIG. 6 will be referred to.

The first seating surface 16, the second seating surface 17, and the third seating surface 18 are disposed at intervals in the front-rear direction in the order of the first seating surface 16, the second seating surface 17, and the third seating surface 18 from the front side. The first seating surface 16 is disposed along a horizontal plane. The first seating surface 16 preferably has a substantially rectangular shape in a plan view. The first seating surface 16 has a curved front end edge 16*a* and a curved rear end edge 16*b*. The first inclined surface 22 is disposed ahead of the first seating surface 16. The first inclined surface 22 is provided along the front end edge 16*a* of the first seating surface 16. The first seating surface 16 and the first inclined surface 22 are continuous with each other. The first inclined surface 22 preferably has a convex surface facing rearward. The first inclined surface 22 preferably has a crescent shape curved rearward in a plan view. The width of the first inclined surface 22 (length in the right-left direction) is preferably larger than the width of the first seating surface 16. The first inclined surface 22 extends obliquely upward to the front side from the first seating surface 16.

The first hip support surface 19 is provided along the rear end edge 16*b* of the first seating surface 16. The first seating surface 16 and the first hip support surface 19 are continuous with each other. The first hip support surface 19 preferably has a concave surface facing rearward. The first hip support surface 19 preferably has a crescent shape curved rearward in a plan view. The first hip support surface 19 includes a curved upper end edge 19*a*. The width of the first hip support surface 19 is preferably larger than the width of the first seating surface 16. The right end portion and the left end portion of the first hip support surface 19 are disposed on the right side and the left side of the first seating surface 16, respectively. Therefore, the first hip support surface 19 extends and turns to the lateral side of the first seating surface 16 from the rear end edge 16*b* of the first seating surface 16. The first hip support surface 19 extends obliquely upward to the rear side from the first seating surface 16.

The second inclined surface 23 is provided along the upper end edge 19*a* of the first hip support surface 19. The first hip support surface 19 and the second inclined surface 23 are continuous with each other. The second inclined surface 23 is preferably a convex surface facing rearward. The second inclined surface 23 preferably has a crescent shape curved rearward in a plan view. The width of the second inclined surface 23 is preferably equal to or substantially equal to the width of the first hip support surface 19. Therefore, the width of the second inclined surface 23 is larger than the width of the first seating surface 16. The second inclined surface 23 extends obliquely downward to the rear side from the upper end edge 19*a* of the first hip support surface 19.

The second seating surface 17 is disposed along a horizontal plane. The second seating surface 17 preferably has a substantially rectangular shape in a plan view. The second seating surface 17 preferably has a curved rear end edge 17*b*. The second hip support surface 20 is provided along the rear end edge 17*b* of the second seating surface 17. The second seating surface 17 and the second hip support surface 20 are continuous with each other. The second hip support surface 20 is preferably a flat surface. The second hip support surface 20 preferably has a crescent shape curved rearward in a plan view. The second hip support surface 20 includes a curved upper end edge 20*a*. The width of the second hip support surface 20 is preferably larger than the width of the second seating surface 17. The second hip support surface 20 extends obliquely upward to the rear side from the second seating surface 17.

The third inclined surface 24 is provided along the upper end edge 20*a* of the second hip support surface 20. The second hip support surface 20 and the third inclined surface 24 are continuous with each other. The third inclined surface 24 preferably has a convex surface facing rearward. The third inclined surface 24 preferably has a crescent shape curved rearward in a plan view. The width of the third inclined surface 24 is preferably equal to or substantially equal to the width of the second hip support surface 20. Therefore, the width of the third inclined surface 24 is larger than the width of the second seating surface 17. The third inclined surface 24 extends obliquely downward to the rear side from the upper end edge 20*a* of the second hip support surface 20.

The third seating surface 18 is disposed along a horizontal plane. The third seating surface 18 preferably has a substantially rectangular shape in a plan view. The third seating surface 18 has a curved rear end edge 18*b*. The third hip support surface 21 is provided along the rear end edge 18*b* of the third seating surface 18. The third hip support surface 21 preferably has a concave surface facing rearward. The third hip support surface 21 preferably has a crescent shape curved rearward in a plan view. The width of the third hip support surface 21 is preferably larger than the width of the third seating surface 18. The third hip support surface 21 extends obliquely upward to the rear side from the third seating surface 18.

The first seating surface 16, the second seating surface 17, and the third seating surface 18 are disposed at different heights in the order of the first seating surface 16, the second seating surface 17, and the third seating surface 18 from the lower side. The upper end of the first hip support surface 19, the upper end of the second hip support surface 20, and the upper end of the third hip support surface 21 are disposed at different heights in the order of the upper end of the first hip support surface 19, the upper end of the second hip support surface 20, and the upper end of the third hip support surface 21 from the lower side. The upper end of the first hip support surface 19 is disposed higher than the first seating surface 16 and the second seating surface 17. The upper end of the second hip support surface 20 is disposed higher than the second seating surface 17 and the third seating surface 18. The upper end of the third hip support surface 21 is disposed higher than the first seating surface 16, the second seating surface 17, and the third seating surface 18.

As shown in FIG. 5, the seat 4 further includes a pair of first side surfaces 4*a*, a pair of second side surfaces 4*b*, and a pair of third side surfaces 4*c*. The pair of first side surfaces 4*a* extend forward while expanding laterally (in a direction away from the central portion of the seat 4 in the right-left direction) from the right end portion and the left end portion of the first seating surface 16 in a plan view. Further, each first side surface 4*a* extends downward while expanding laterally from the side portion (right end portion or left end portion) of the first seating surface 16 (refer to FIG. 4). Specifically, each first side surface 4*a* extends downward to the front side while expanding laterally from the side portion of the first seating surface 16. Similarly, each second side surface 4*b* extends downward to the front side while expanding laterally from the side portion of the second seating surface 17, and each third side surface 4*c* extends downward to the front side while expanding laterally from the side portion of the third seating surface 18. As shown in FIG. 5, each first side surface 4*a* is arranged so that at least a portion of the first side surface 4*a* is positioned on the lateral side of the first inclined surface 22 in a plan view. Specifically, each first side surface 4*a* extends to the lateral side of the first inclined surface 22 from the side portion of the first seating surface 16. Similarly, each second side surface 4*b* extends to the lateral side of the second inclined surface 23 from the side portion of the second seating surface 17, and each third side surface 4*c* extends to the lateral side of the third inclined surface 24 from the side portion of the third seating surface 18.

Figure 7:
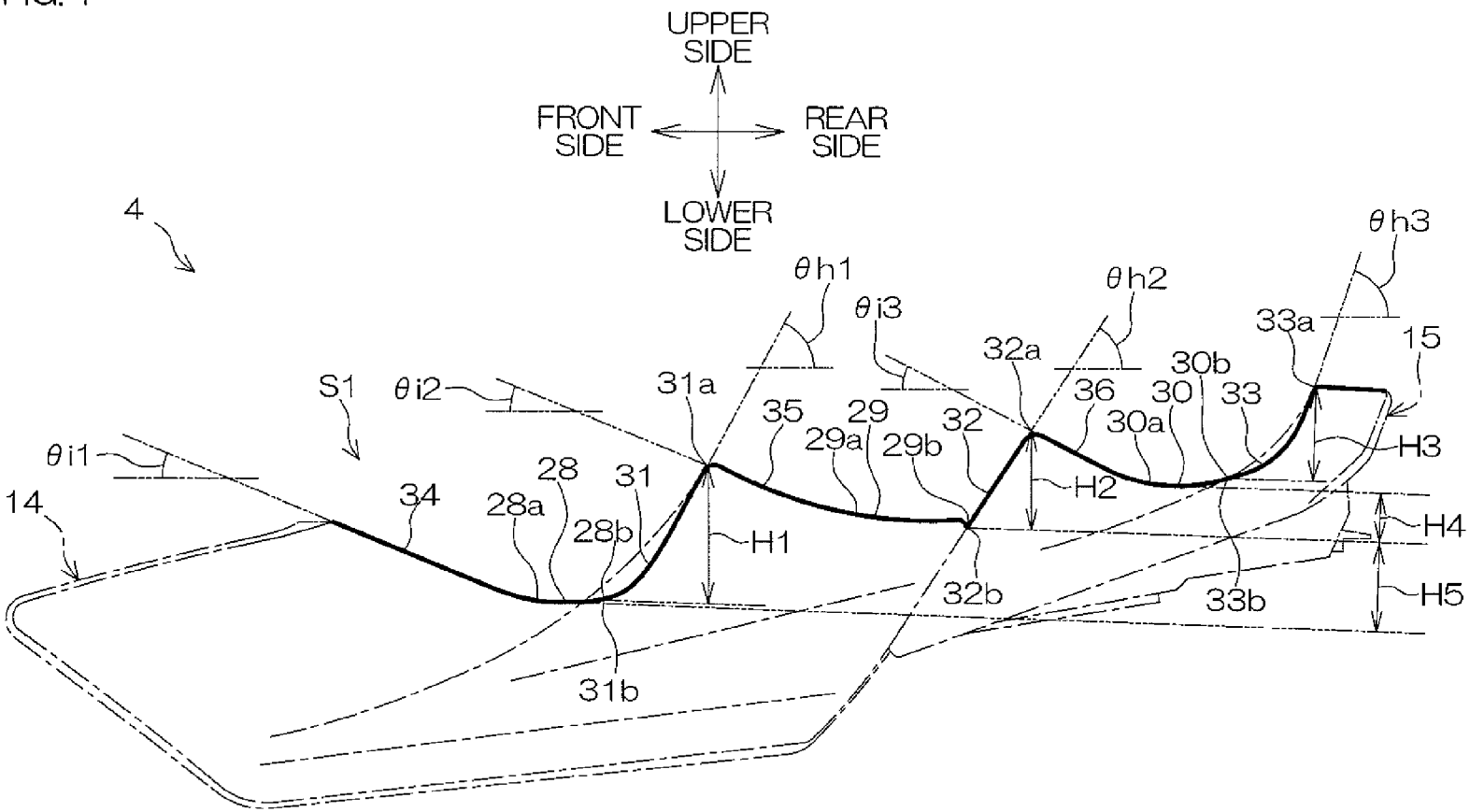
FIG. 7 is a view for describing a vertical sectional shape of the seat according to the first preferred embodiment of the present invention.

FIG. 7 is a view for describing the vertical sectional shape S1 of the seat 4 according to the first preferred embodiment of the present invention. In FIG. 7, a sectional shape S1 of the upper end edge of the seat 4 that appears when the seat 4 is cut along a vertical plane P1 (refer to FIG. 2) along the center in the width direction of the personal watercraft 1 is shown by a thick solid line. In FIG. 7, a contour that is observed when the seat 4 is viewed horizontally from the lateral side is shown by alternate long and short dashed lines. A portion overlapping the sectional shape S1 of the upper end edge of the seat 4 of the contour observed when the seat 4 is viewed horizontally from the lateral side is shown by a thick solid line.

The seat 4 has the vertical sectional shape S1 that appears when the seat 4 is cut along the vertical plane P1 along the center in the width direction of the personal watercraft 1. The vertical sectional shape S1 of the seat 4 includes three seat portions (a first seat portion 28, a second seat portion 29, and a third seat portion 30). The vertical sectional shape S1 of the seat 4 further includes three hip support portions (a first hip support portion 31, a second hip support portion 32, and a third hip support portion 33) and three inclined portions (a first inclined portion 34, a second inclined portion 35, and a third inclined portion 36). The first seat portion 28, the second seat portion 29, and the third seat portion 30 are portions of the first seating surface 16, the second seating surface 27, and the third seating surface 18, respectively. The first hip support portion 31, the second hip support portion 32, and the third hip support portion 33 are portions of the first hip support surface 19, the second hip support surface 20, and the third hip support surface 21, respectively. The first inclined portion 34, the second inclined portion 35, and the third inclined portion 36 are portions of the first inclined surface 22, the second inclined surface 23, and the third inclined surface 24. The second inclined portion 35 is an example of the first rearward inclined portion according to the first preferred embodiment of the present invention, and the third inclined portion 36 is an example of the second rearward inclined portion according to the first preferred embodiment of the present invention.

The first seat portion 28, the second seat portion 29, and the third seat portion 30 are disposed at intervals in the front-rear direction. Further, the first seat portion 28, the second seat portion 29, and the third seat portion 30 are disposed along a horizontal plane at different heights so that the second seat portion 29 is positioned at a height between the first seat portion 28 and the third seat portion 30. In detail, the second seat portion 29 is disposed along a horizontal plane rearward relative to the first seat portion 28 and higher than the first seat portion 28. The third seat portion 30 is disposed along a horizontal plane rearward relative to the second seat portion 29 and higher than the second seat portion 29. The first seat portion 28, the second seat portion 29, and the third seat portion 30 may be horizontal, or may be inclined with respect to a horizontal plane. Further, the first seat portion 28, the second seat portion 29, and the third seat portion 30 may have undulations.

The height difference H4 between the second seat portion 29 and the third seat portion 30 is smaller than the height difference H5 between the first seat portion 28 and the second seat portion 29. For example, when the second seat portion 29 is inclined with respect to a horizontal plane and the third seat portion 30 is horizontal, the height difference H4 between the second seat portion 29 and the third seat portion 30 is the height difference between the lowest portion of the second seat portion 29 and the third seat portion 30. When both of the second seat portion 29 and the third seat portion 30 are inclined with respect to a horizontal plane, the height difference H4 between the second seat portion 29 and the third seat portion 30 is the height difference between the lowest portion of the second seat portion 29 and the lowest portion of the third seat portion 30. Specifically, the height difference H4 between the second seat portion 29 and the third seat portion 30 is the height difference between the lowest portion of the second seat portion 29 and the lowest portion of the third seat portion 30. The same applies to the height difference H5 between the first seat portion 28 and the second seat portion 29.

On the other hand, the first hip support portion 31, the second hip support portion 32, and the third hip support portion 33 are disposed at intervals in the front-rear direction. In detail, the first hip support portion 31 is disposed rearward relative to the first seat portion 28 and forward relative to the second seat portion 29. The first hip support portion 31 extends rearward to a height higher than the second seat portion 29 from the rear end 28*b* of the first seat portion 28. The second hip support portion 32 is disposed rearward relative to the second seat portion 29 and forward relative to the third seat portion 30. The second hip support portion 32 extends rearward to a height higher than the third seat portion 30 and higher than the upper end 31*a* of the first hip support portion 31 from the rear end 29*b* of the second seat portion 29. The third hip support portion 33 is disposed rearward relative to the third seat portion 30. The third hip support portion 33 extends rearward to a height higher than the upper end 32*a* of the second hip support portion 32 from the rear end 30*b* of the third seat portion 30.

The first hip support portion 31 is inclined so that the upper end 31*a* of the first hip support portion 31 is positioned rearward relative to the lower end 31*b* of the first hip support portion 31. Similarly, the second hip support portion 32 is inclined so that the upper end 32*a* of the second hip support portion 32 is positioned rearward relative to the lower end 32*b* of the second hip support portion 32. Similarly, the third hip support portion 33 is inclined so that the upper end 33*a* of the third hip support portion 33 is positioned rearward relative to the lower end 33*b* of the third hip support portion 33. The first hip support portion 31 may be inclined at a constant inclined angle, or may be inclined so that its inclination angle changes. The same applies to the second hip support portion 32 and the third hip support portion 33. In the first preferred embodiment, the first hip support portion 31 and the third hip support portion 33 are preferably inclined so that their inclination angles change continuously, and the second hip support portion 32 is preferably inclined at a constant inclination angle.

The inclination angle θh2 of the second hip support portion 32 with respect to a horizontal plane is slightly smaller than the inclination angle θh1 of the first hip support portion 31 with respect to a horizontal plane. The inclination angle θh2 of the second hip support portion 32 with respect to a horizontal plane is slightly smaller than the inclination angle θh3 of the third hip support portion 33 with respect to a horizontal plane. The inclination angles θh1, θh2, and θh3 of the hip support portions 31 to 33 with respect to a horizontal plane are maximum inclination angles with respect to a horizontal plane. The inclination angle θh2 may be equal to or larger than the inclination angle θh1. Similarly, the inclination angle θh2 may be equal to or larger than the inclination angle θh3.

The height difference H1 between the upper end 31*a* of the first hip support portion 31 and the lower end 31*b* of the first hip support portion 31 is larger than the height difference H2 between the upper end 32*a* of the second hip support portion 32 and the lower end 32*b* of the second hip support portion 32. Further, the height difference H1 is larger than the height difference H3 between the upper end 33*a* of the third hip support portion 33 and the lower end 33*b* of the third hip support portion 33. The height difference H2 is equal to or substantially equal to the height difference H3. The height difference H1 may be equal to or smaller than the height difference H2. Similarly, the height difference H1 may be equal to or smaller than the height difference H3.

The length of the first hip support portion 31 (length along the first hip support portion 31) is longer than the length of the second hip support portion 32 (length along the second hip support portion 32). Similarly, the length of the first hip support portion 31 is longer than the length of the third hip support portion 33 (length along the third hip support portion 33). The second hip support portion 32 preferably has a length (length along the second hip support portion 32) that is not less than half the length of the first hip support portion 32, and the third hip support portion 33 preferably has a length (length along the third hip support portion 33) that is not less than half the length of the first hip support portion 31. The length of the second hip support portion 32 is equal to or substantially equal to the length of the third hip support portion 33.

On the other hand, the first inclined portion 34, the second inclined portion 35, and the third inclined portion 36 are disposed at intervals in the front-rear direction. In detail, the first inclined portion 34 is disposed forward relative to the first seat portion 28. The first inclined portion 34 is connected to the front end 28*a* of the first seat portion 28. The second inclined portion 35 is disposed rearward relative to the first hip support portion 31 and forward relative to the second seat portion 29. The second inclined portion 35 connects the upper end 31*a* of the first hip support portion 31 and the front end 29*a* of the second seat portion 29. The third inclined portion 36 is disposed rearward relative to the second hip support portion 32 and forward relative to the third seat portion 30. The third inclined portion 36 connects the upper end 32*a* of the second hip support portion 32 and the front end 30*a* of the third seat portion 30.

The first inclined portion 34 is inclined so that the upper end of the first inclined portion 34 is positioned forward relative to the lower end of the first inclined portion 34. Similarly, the second inclined portion 35 is inclined so that the upper end of the second inclined portion 35 is positioned forward relative to the lower end of the second inclined portion 35, and the third inclined portion 36 is inclined so that the upper end of the third inclined portion 36 is positioned forward relative to the lower end of the third inclined portion 36. The first inclined portion 34 may be inclined at a constant inclination angle, or may be inclined so that its inclination angle changes. The same applies to the second inclined portion 35 and the third inclined portion 36. In the first preferred embodiment, the first inclined portion 34, the second inclined portion 35, and the third inclined portion 36 are inclined so that their inclination angles change continuously.

The inclination angles θi1, θi2, and θi3 of the inclined portions 34 to 36 with respect to a horizontal plane are substantially equal despite slight differences among them. In detail, the inclination angle θi1 of the first inclined portion 34 with respect to a horizontal plane is slightly larger than the inclination angle θi2 of the second inclined portion 35 with respect to a horizontal plane. Similarly, the inclination angle θi3 of the third inclined portion 36 with respect to a horizontal plane is slightly larger than the inclination angle θi2 of the second inclined portion 35 with respect to a horizontal plane. The inclination angles θi1, θi2, and θi3 of the inclined portions 34 to 36 with respect to a horizontal plane are maximum inclination angles with respect to a horizontal plane. The inclination angle θi1 may be equal to or smaller than the inclination angle θi2.

As described above, in the first preferred embodiment, the first hip support portion 31, the second hip support portion 32, and the third hip support portion 33 corresponding to the first seat portion 28, the second seat portion 29, and the third seat portion 30 are preferably provided on the seat 4. The hip support portions 31 to 33 extend obliquely upward to the rear side from the rear ends of the corresponding seat portions 28 to 30. Accordingly, a sufficient height is secured for each of the hip support portions 31 to 33. Therefore, when a rider sits on any of the seat portions 28 to 33, the hips of the rider are supported by any of the hip support portions 31 to 33. Further, the first seat portion 28, the second seat portion 29, and the third seat portion 30 are disposed along a horizontal plane at different heights so that the second seat portion 29 is positioned at a height between the first seat portion 28 and the third seat portion 30. The height difference H4 between the second seat portion 29 and the third seat portion 30 is smaller than the height difference H5 between the first seat portion 28 and the second seat portion 29. Therefore, an increase in the total height of the seat 4 is minimized. Further, the third inclined portion 36 is inclined at the inclination angle θi3 larger than the inclination angle θi2 of the second inclined portion 35 with respect to a horizontal plane. Therefore, an increase in the total height of the seat 4 is minimized, and the height of the second hip support portion 32 increases. Therefore, the hips of a rider sitting on the second seat portion 29 are supported by the second hip support portion 32. Accordingly, while an increase in the total height of the seat 4 is minimized, the comfort of the riders can be improved.

The present application corresponds to Japanese Patent Application No. 2011-005025 filed in the Japan Patent Office on Jan. 13, 2011, and the entire disclosure of this application is incorporated herein by reference.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A personal watercraft comprising:

a seat having a sectional shape cut along a vertical plane along a center in a width direction of the personal watercraft, the sectional shape of the seat including:

a first seat portion disposed substantially along a first horizontal plane;

a second seat portion disposed substantially along a second horizontal plane rearward relative to the first seat portion and higher than the first seat portion;

a third seat portion disposed substantially along a horizontal plane rearward relative to the second seat portion and higher than the second seat portion, a height difference between the second seat portion and the third seat portion being smaller than a height difference between the first seat portion and the second seat portion;

a first hip support portion disposed forward relative to the second seat portion, the first hip support portion arranged to extend rearward from a rear end of the first seat portion and to a height higher than the second seat portion;

a second hip support portion disposed forward relative to the third seat portion, the second hip support portion arranged to extend rearward from a rear end of the second seat portion and to a height higher than the third seat portion and higher than an upper end of the first hip support portion;

a third hip support portion arranged to extend rearward from a rear end of the third seat portion and to a height higher than an upper end of the second hip support portion;

a first rearward inclined portion arranged to connect the upper end of the first hip support portion and a front end of the second seat portion, the first rearward inclined portion inclined such that an upper end of the first rearward inclined portion is positioned forward relative to a lower end of the first rearward inclined portion; and a second rearward inclined portion arranged to connect the upper end of the second hip support portion and a front end of the third seat portion, the second rearward inclined portion inclined at an inclination angle larger than an inclination angle of the first rearward inclined portion with respect to a horizontal plane such that an upper end of the second rearward inclined portion is positioned forward relative to a lower end of the second rearward inclined portion.

2. The personal watercraft according to claim 1, wherein the first hip support portion is inclined such that the upper end of the first hip support portion is positioned rearward relative to a lower end of the first hip support portion; and the second hip support portion is inclined at an inclination angle smaller than an inclination angle of the first hip support portion with respect to a horizontal plane such that the upper end of the second hip support portion is positioned rearward relative to a lower end of the second hip support portion.

3. The personal watercraft according to claim 1, wherein a height difference between the upper end of the second hip support portion and the lower end of the second hip support portion is equal to or substantially equal to a height difference between an upper end of the third hip support portion and a lower end of the third hip support portion.

* * * * *